US006408820B1

(12) United States Patent
LaMarr, Jr.

(10) Patent No.: US 6,408,820 B1
(45) Date of Patent: Jun. 25, 2002

(54) CAPACITOR DISCHARGE ENGINE IGNITION SYSTEM WITH AUTOMATIC IGNITION ADVANCE AND/OR MINIMUM IGNITION SPEED CONTROL

(75) Inventor: Gerald L. LaMarr, Jr., Bay City, MI (US)

(73) Assignee: Walbro Corporation, Cass City, MI (US)

( * ) Notice: Subject to any disclaimer, the term of this patent is extended or adjusted under 35 U.S.C. 154(b) by 0 days.

(21) Appl. No.: 09/631,005

(22) Filed: Aug. 2, 2000

(51) Int. Cl.[7] ..... F02P 5/145
(52) U.S. Cl. ..... 123/406.57; 123/599
(58) Field of Search ..... 123/406.57, 599

(56) References Cited

U.S. PATENT DOCUMENTS

| | | | | | |
|---|---|---|---|---|---|
| 4,399,801 | A | * | 8/1983 | Kondo et al. | 123/406.57 |
| 5,024,204 | A | * | 6/1991 | Dykstra | 123/599 |
| 5,025,498 | A | | 6/1991 | Agren | |
| 5,245,965 | A | | 9/1993 | Andersson | |
| 5,630,404 | A | * | 5/1997 | Regazzi et al. | 123/406.57 |
| 5,806,503 | A | * | 9/1998 | McLeod | 123/406.57 |
| 5,855,199 | A | * | 1/1999 | McLeod | 123/599 |
| 5,931,137 | A | * | 8/1999 | McLeod et al. | 123/406.57 |
| 5,954,027 | A | * | 9/1999 | Suzuki | 123/406.57 |

* cited by examiner

*Primary Examiner*—Erick Solis
(74) *Attorney, Agent, or Firm*—Reising, Ethington, Barnes, Kisselle, Learman & McCulloch, P.C.

(57) ABSTRACT

A capacitor discharge engine ignition system includes an ignition coil having a primary winding and a secondary winding for coupling to an engine ignition spark plug. A first electronic switch has primary current conducting electrodes in circuit with an ignition charge storage capacitor and the primary winding of the ignition coil, and a control electrode responsive to-trigger signals for operatively connecting the ignition charge storage capacitor to discharge through the primary winding of the, ignition coil. A charge/trigger coil arrangement generates periodic signals in synchronism with operation of the engine. The charge coil generates a charge signal to charge the ignition charge storage capacitor, while the trigger coil generates a trigger signal for triggering discharge of the capacitor through the ignition coil. An electronic circuit for controlling timing of the trigger signals as a function of engine speed includes a second electronic switch in the form of an SCR having primary anode and cathode current conducting electrodes operatively connected to the control electrode of the first electronic switch, and a control gate electrode. An RC circuit, including a resistor and a capacitor, is operatively connected to the charge coil and the gate electrode of the SCR to prevent application of trigger signals to the control electrode of the first electronic switch during occurrence of the charge signal, and thereby control timing of application of the trigger signal to the control electrode of the first electronic switch. A third electronic switch has primary current conducting electrodes connected between the trigger coil and the control electrode of the first electronic switch, and a control electrode connected through a zener diode to the ignition charge storage capacitor. The third electronic switch prevents application of trigger signals to the control electrode of the first electronic switch at low engine speeds until the voltage stored on the ignition charge storage capacitor exceeds the zener breakdown voltage of the zener diode.

6 Claims, 3 Drawing Sheets

CAPACITOR DISCHARGE ENGINE IGNITION SYSTEM WITH AUTOMATIC IGNITION ADVANCE AND/OR MINIMUM IGNITION SPEED CONTROL

The present invention is directed to capacitor discharge engine ignition systems for small two and four stroke engines used in chain saw and weed trimmer applications, for example. The invention is more specifically directed to automatic control of engine ignition timing to obtain spark advance between starting and normal operating speeds, to inhibit ignition at excess engine operating speed and/or to prevent engine ignition at less than a minimum operating speed.

BACKGROUND AND SUMMARY OF THE INVENTION

The time and occurrence of engine ignition is of importance to startability, output power and emissions performance of engines, including small two and four stroke engines. Optimum engine timing varies, primarily as a function of engine speed and load. Secondary factors, such as emissions performance and fuel quality, also play a role in determining optimum spark timing. Mechanical and microprocessor-based electronic timing control systems have been proposed for large engine applications, such as automotive engines, but are not well suited to small engine applications because of cost and packaging factors. Specifically, it has been proposed to employ microprocessor-based ignition modules in small engine applications, in which desired spark advance and/or retard timing characteristics may be programmed into the microprocessor. However, cost factors associated with microprocessor-based modules are prohibitive in small engine applications. It is a general object of the present invention to provide a capacitor discharge engine ignition system that is particularly well suited for small engine applications, that eliminates kick-back during starting, that facilitates manual starting of the engine, that facilitates engine carburetor timing, that exhibits increased power, that is relatively inexpensive, and/or that is well adapted for use in small two stroke and four stroke engine applications.

A capacitor discharge engine ignition system in accordance with one aspect of the present invention includes an ignition coil having a primary winding and a secondary winding for coupling to an engine ignition spark plug. A first electronic switch has primary current conducting electrodes in circuit with an ignition charge storage capacitor and the primary winding of the ignition coil, and a control electrode responsive to trigger signals for operatively connecting the ignition charge storage capacitor to discharge through the primary winding of the ignition coil. A charge/trigger coil arrangement generates periodic signals in synchronism with operation of the engine. The charge coil generates a charge signal to charge the ignition charge storage capacitor, while the trigger coil generates a trigger signal for triggering discharge of the capacitor through the ignition coil. An electronic circuit for controlling timing of the trigger signals as a function of engine speed includes a second electronic switch in the form of an SCR having primary anode and cathode current conducting electrodes operatively connected to the control electrode of the first electronic switch, and a control gate electrode. An RC circuit, including a resistor and a capacitor, is operatively connected to the charge coil and the gate electrode of the SCR to prevent application of trigger signals to the control electrode of the first electronic switch during occurrence of the charge signal, and thereby control timing of application of the trigger signal to the control electrode of the first electronic switch.

In accordance with a second aspect of the present invention, which may be implemented separately from or more preferably in combination with the first aspect of the invention summarized above, a capacitor discharge engine ignition system includes the ignition coil, first electronic switch, ignition charge storage capacitor and charge/trigger coil arrangement as described above. A third electronic switch has primary current conducting electrodes connected between the trigger coil and the control electrode of the first electronic switch, and a control electrode operatively coupled to the engine charge storage capacitor, preferably through a zener diode. The third electronic switch prevents application of trigger signals to the control electrode of the first electronic switch until the voltage on the ignition charge storage capacitor exceeds the zener breakdown voltage of the zener diode—i.e., when engine speed exceeds a preselected level.

BRIEF DESCRIPTION OF THE DRAWINGS

The invention, together with additional objects, features and advantages thereof, will be best understood from the following description, the appended claims and the accompanying drawings in which:

DETAILED DESCRIPTION OF PREFERRED EMBODIMENTS

Figure 1:
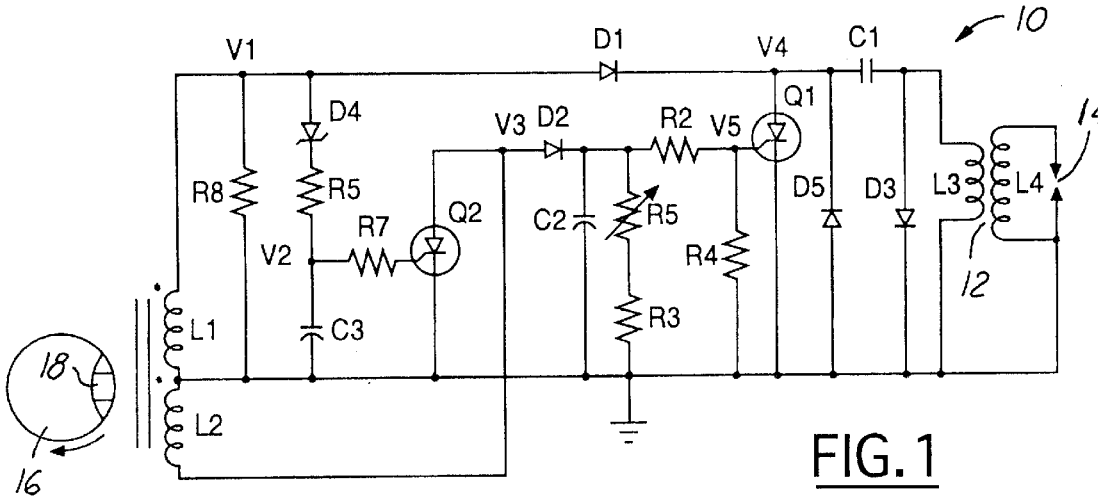
FIG. 1 is an electrical schematic diagram of a capacitor discharge engine ignition system in accordance with one presently preferred embodiment of the invention.

FIG. 1 illustrates a capacitor discharge engine ignition system 10 in accordance with one presently preferred embodiment of the invention as comprising an ignition coil 12 having a primary winding L3 and a secondary winding L4 coupled to a spark plug 14 for initiating ignition at an engine. A flywheel 16 is suitably coupled to the engine crankshaft, and carries at least one magnet 18 that rotates in synchronism with engine operation. An ignition charge coil L1 has one end connected in series through a diode D1, an ignition charge storage capacitor C1 and primary winding L3 of coil 12. The opposing end of coil L1 is connected to electrical ground. A trigger coil L2 is operatively connected to the gate of an SCR Q1. The primary current conducting anode and cathode electrodes of SCR Q1 are connected to capacitor C1 and electrical ground across the series combination of capacitor C1 and primary winding L3. A pair of diodes D3, D5 are connected across SCR Q1 and winding L3 respectively.

Charge coil L1 is connected through a zener diode D4 and a resistor R5 to the junction of a capacitor C3 and a resistor R7. The combination of capacitor C3 and resistors R5, R7 form an RC network to control operation of an SCR Q2. A resistor R8 is connected across charge coil L1. SCR Q2 has a control electrode or gate connected to resistor R7, a cathode connected to ground, and an anode connected to coil L2. The anode of SCR Q2 is also connected through a diode D2 and a resistor R2 to the gate of SCR Q1. The junction of diode D2 and resistor R2 is connected to ground through the parallel combination of a capacitor C2 and series resistors R3, R5. A resistor R4 is connected between the gate of SCR Q1 and electrical ground.

Figure 2:
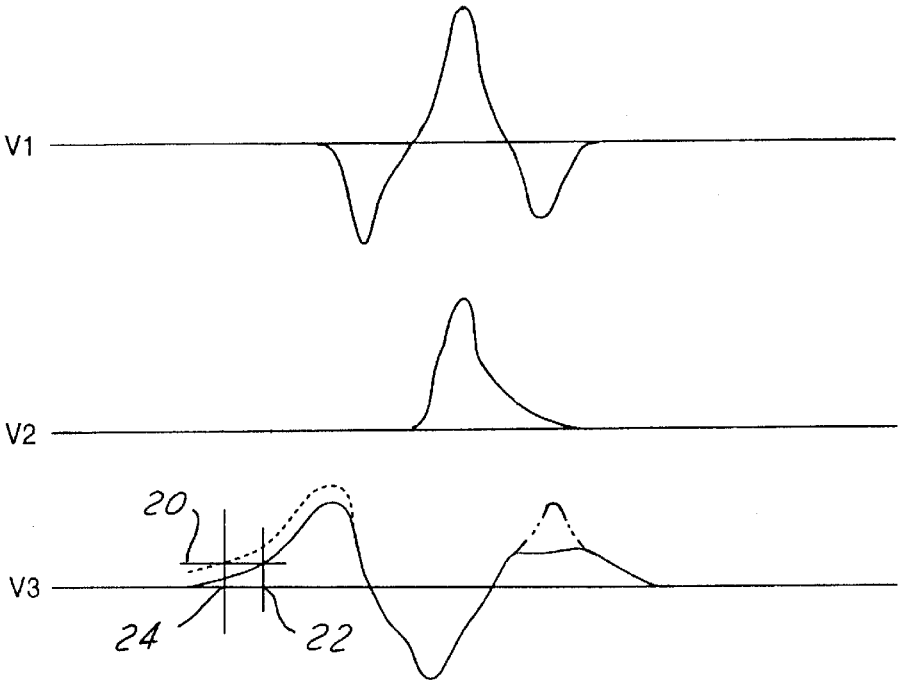
FIGS. 2 and 3 are signal timing diagrams useful in explaining operation of the embodiment of the invention illustrated in FIG. 1.
Figure 3:
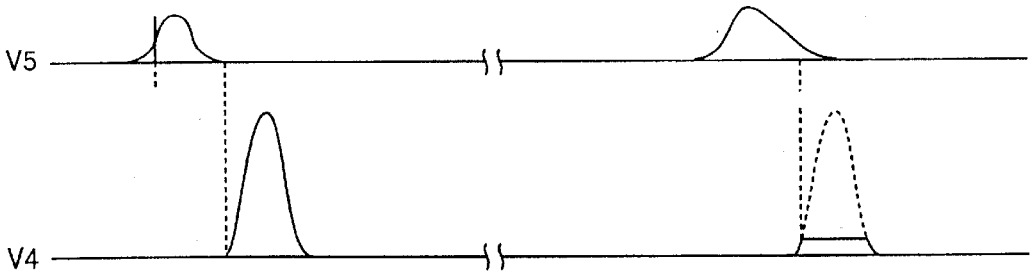

Referring to FIGS. 1–3, signal V1 illustrates the voltage generated by charge coil L1, which is half-way rectified by diode D1 and applied to ignition charge storage capacitor C1. Voltage V1 is also half-way rectified by diode D4 and applied through resistor R5 to capacitor C3. This voltage V2 on capacitor C3 functions through SCR Q2 to short circuit trigger coil L2 during occurrence of the positive cycle of the charge signal V1, and continues to hold SCR Q2 closed for a time necessary for capacitor C3 to discharge through resistor R7. Thus, the second cycle of the trigger signal is effectively short circuited, preventing closure of SCR Q1. The charge is thus held on capacitor C1 until the next trigger coil signal cycle. This suppression of the second positive trigger pulse by SCR Q2 alters the leading edge of the next succeeding trigger pulse that appears on the next cycle of operation, as illustrated at V3 in FIG. 2. The amplitude of the leading trigger signal pulse increases as a function of speed. Thus, the time at which the trigger signal voltage applied through resistor R2 to the gate of SCR Q1 exceeds the SCR gate trigger level 20 advances with increasing engine speed. Thus, in FIG. 2, ignition occurs at time 22 at low engine speed, and advances to time 24 at higher engine speed. The speed dependent waveform V3 of FIG. 2 thus creates the timing advance feature of the present invention.

High speed operation is illustrated in FIG. 3. At normal operating speed, the voltage V5 stored on capacitor C2 from trigger coil L2 has sufficient time to discharge between engine operating cycles to allow storage of voltage V4 across capacitor C1. However, at higher engine operating speeds, capacitor C2 retains sufficient charge to maintain SCR Q1 in a conductive condition upon occurrence of the next charge signal, effectively short circuiting ignition charge storage capacitor C1. Thus, charge is not stored on capacitor C1, and the next trigger signal does not initiate a spark at the engine spark plug. The engine thus skips a spark, retarding engine operation and slowing engine speed.

Figure 4:
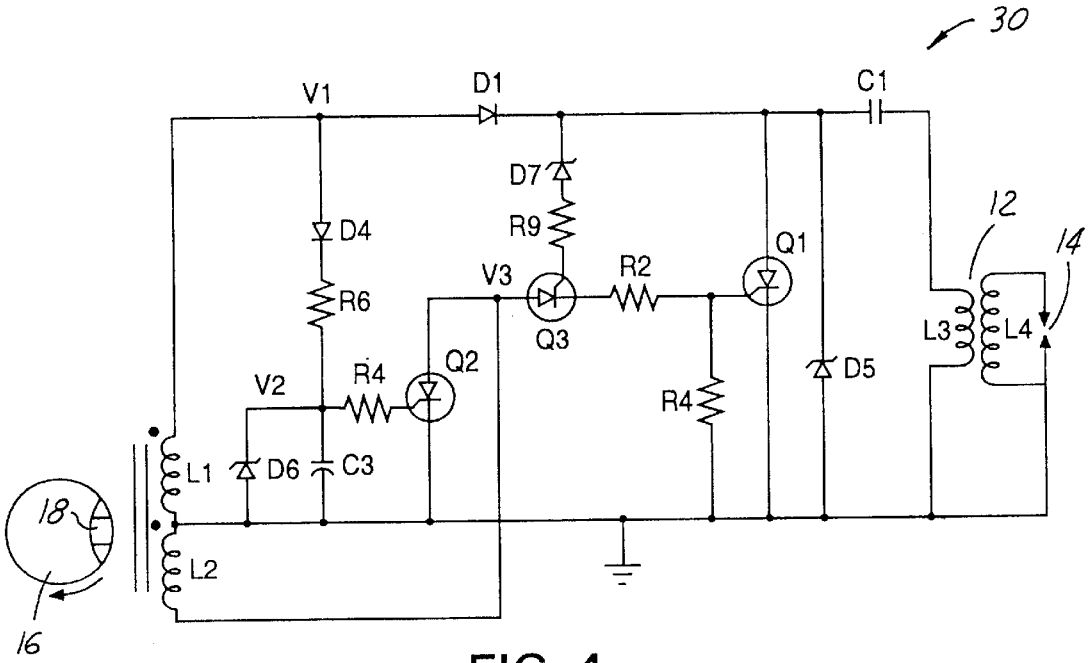
FIG. 4 is an electrical schematic diagram of a capacitor discharge engine ignition system in accordance with another presently preferred embodiment of the invention.
Figure 5:
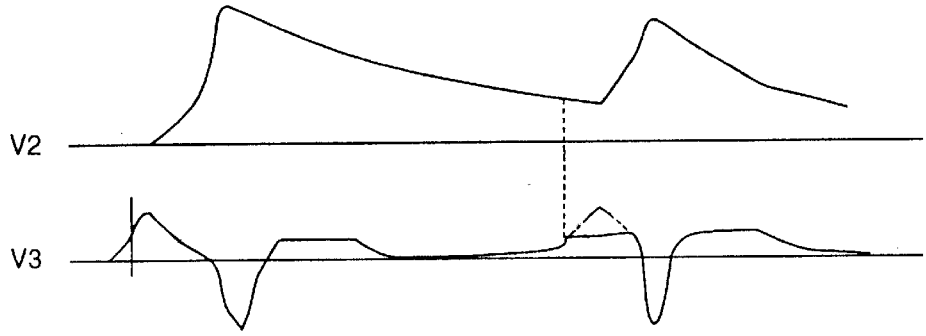
FIG. 5 is a signal timing diagram useful in explaining operation of the embodiment of the invention illustrated in FIG. 4.

FIG. 4 illustrates a capacitor discharge engine ignition system 30 in accordance with a modified embodiment of the invention. In this embodiment, the combination of resistors R4, R6, capacitor C3 and SCR Q2 perform both the automatic spark advance and over-speed spark suppression features of the system. Thus, referring to FIGS. 4 and 5, when voltage V2 across capacitor C3 does not have an opportunity fully to discharge between operating cycles, voltage V2 maintains SCR Q2 conductive. The first and second cycles of the trigger signal are effectively short circuited, preventing any closure of SCR Q1. This prevents any sparks at the engines spark plug. FIG. 4 illustrates another aspect of the invention, in which an SCR Q3 has an anode connected to trigger coil L2 and the anode of SCR Q2, and a cathode connected through resistor R2 to the gate of SCR Q1. The gate of SCR Q3 is connected through a resistor R9 and a zener diode D7 to the junction of diode D1 and capacitor C1. SCR Q3 thus blocks application of trigger signals from coil L2 to the gate of SCR Q1 until the voltage on capacitor C3 exceeds the zener breakdown voltage of diode D7. Zener diode D7 may have a breakdown voltage of 120 volts, for example, when the voltage on capacitor C1 at normal operating speeds is on the order of 300 volts. When engine speed is sufficiently low that the voltage on capacitor C1 does not exceed the breakdown voltage of diode D7—e.g., 120 volts—application of trigger signals to SCR Q1 is suppressed. Thus, in this example, the engine will not spark at low operating speed below on the order of 800 to 900 rpm, for example.

Figure 6:
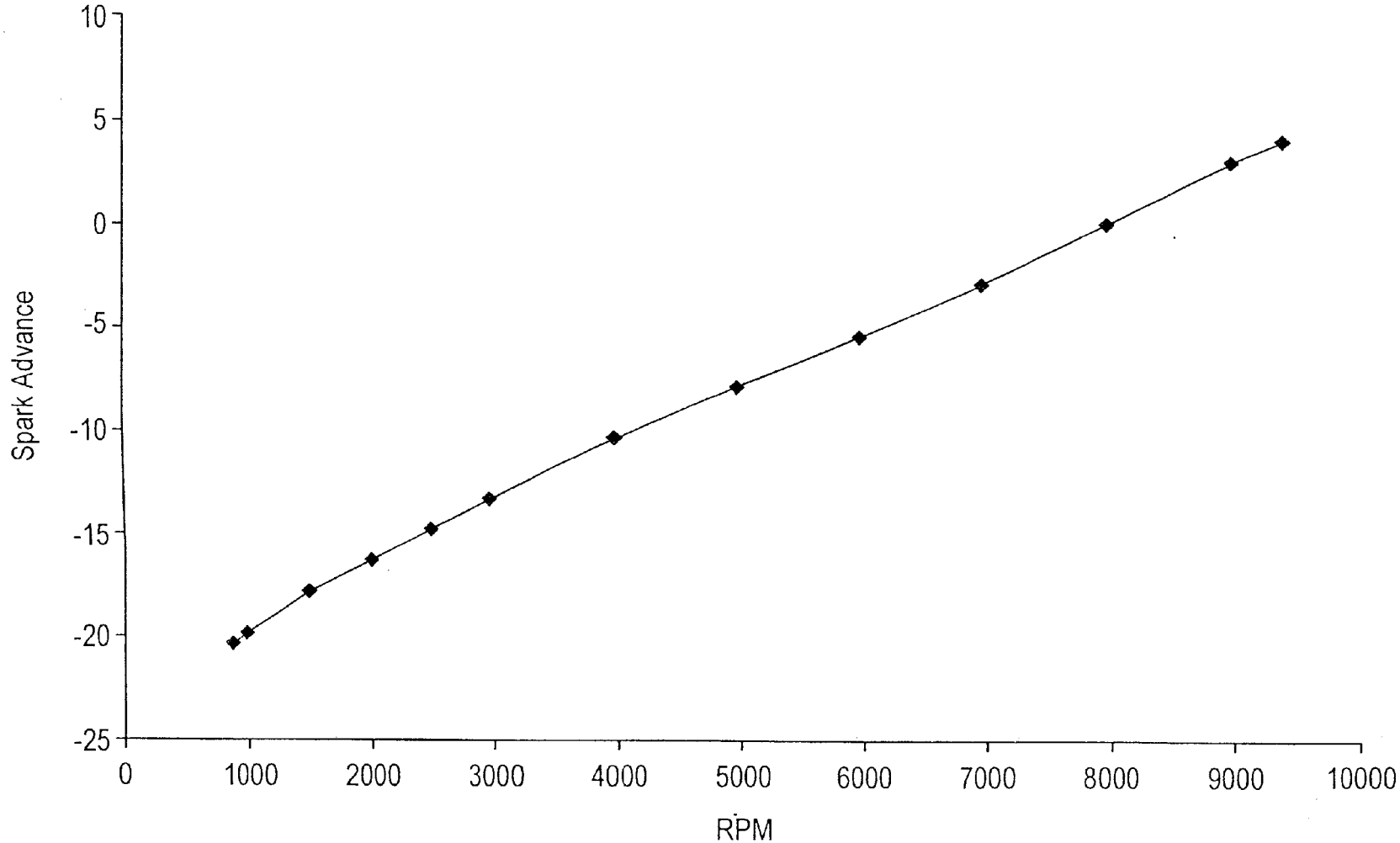
FIG. 6 is an engine timing spark advance diagram applicable to both embodiments of the invention illustrated in FIGS. 1 and 4.

FIG. 6 illustrates spark advance angle versus engine rpm for both embodiments of the invention. Engine ignition is suppressed below about 800 to 900 rpm. This is accomplished in the embodiment of FIG. 1 by the voltage divider formed by resistors R2 and R4. Below about 800–900 rpm, trigger coil L2 does not generate enough voltage across capacitor C2 to trigger SCR Q1 through the voltage divider R2, R4. In the embodiment of FIG. 4, engine ignition is suppressed below about 800–900 rpm by the combination of SCR Q3, resistor R9 and zener diode D7 as described above. Spark advance angle varies linearly with engine speed up to a maximum speed on the order of about 9500 rpm in the illustrated example. Above this speed, engine spark is suppressed by the combination of capacitor C2 and resistors R2, R3, R4, R5 in the embodiment of FIG. 1, and the combination of resistors R4, R6, capacitor C3 and diode D6 in the embodiment of FIG. 4.

There has thus been disclosed a capacitor discharge engine ignition system that fully satisfies all of the objects and aims previously set forth. Automatic spark advance reduces or eliminates kick-back on initial starting, generally facilitates starting of the engine, and facilitates tuning of the engine carburetor. Automatic spark suppression at excess engine speed reduces engine over speed and possible damage to the engine. The system of the present invention can be implemented employing low-cost analog components, and is usable on either two stroke or four stroke engines. A number of modifications and variations have been disclosed. Other modifications and variations will readily suggest themselves to persons of ordinary skill in the art. The invention is intended to embrace all such modifications and variations as fall within the spirit and broad scope of the appended claims.

What is claimed is:

1. A capacitor discharge engine ignition system that includes:

ignition coil means having a primary winding and a secondary winding for coupling to. engine ignition means, an ignition charge storage capacitor coupled to said primary winding, first electronic switch means having primary current conducting electrodes in circuit with said ignition charge storage capacitor and said primary winding, and a control electrode responsive to trigger signals for operatively connecting said ignition charge storage capacitor to discharge through said primary winding, charge/trigger coil means for generating periodic signals in synchronism with operation of the engine, including charge coil means for generating a charge signal to charge said ignition charge storage capacitor and trigger coil means for generating said trigger signal, means for controlling timing of said trigger signal as a function of engine speed comprising second electronic switch means including an SCR having a gate electrode, and an anode and cathode operatively connected to said control electrode of said first electronic switch-means, and an RC circuit, including a resistor and a second capacitor, operatively connecting said charge coil to said gate electrode of said SCR to prevent application of said trigger signal to said control electrode of said first electronic switch means as a function of engine speed, said means for controlling timing of said trigger signal comprising means for advancing timing of said trigger signal as a function of increasing engine speed, suppression of said trigger signal during occurrence of said charge signal automatically advancing occurrence of said trigger signal following occurrence of said charge signal, and third electronic switch means having primary current conducting electrodes operatively connected between said trigger coil means and said control electrode of said first electronic switch means, and a control electrode operatively coup led to said ignition charge storage capacitor.

2. The system set forth in claim 1 further comprising a zener diode connecting said control electrode of said third electronic switch means to said ignition charge storage capacitor such that said third electronic switch means conducts trigger signals to said control electrode of said first electronic switch means only when voltage on said ignition charge storage capacitor exceeds the zener breakdown voltage of said zener diode.

3. A capacitor discharge engine ignition system that includes:

ignition coil means having a primary winding and a secondary winding for coupling to engine ignition means, an ignition charge storage capacitor coupled to said primary winding, first electronic switch means having primary current conducting electrodes in circuit with said ignition charge storage capacitor and said primary winding, and a control electrode responsive to trigger signals for operatively connecting said ignition charge storage capacitor to discharge through said primary winding, charge/trigger coil means for generating periodic signals in synchronism with operation of the engine, including charge coil means for generating a charge signal to charge said ignition charge storage capacitor and trigger coil means for generating said trigger signal, second electronic switch means having primary current conducting electrodes operatively connected between said trigger coil means and said control electrode of said first electronic switch means, and a control electrode, and a zener diode connecting said control electrode of said second electronic switch means to said ignition charge storage capacitor such that said second electronic switch means conducts trigger signals to said control electrode of said first electronic switch means only when voltage on said ignition charge storage capacitor exceeds the zener breakdown voltage of said zener diode.

4. The system set forth in claim 3 further comprising means for controlling timing of said trigger signal as a function of engine speed comprising third electronic switch means including an SCR having a gate electrode, and an anode and cathode operatively connected to said control electrode of said first electronic switch means, and an RC circuit, including a resistor and a second capacitor, operatively connecting said charge coil to said gate electrode of said SCR to prevent application of said trigger signal to said control electrode of said first electronic switch means as a function of engine speed.

5. The system set forth in claim 4 wherein said means for controlling timing of said trigger signal comprises means for advancing timing of said trigger signal as a function of increasing engine speed, wherein suppression of said trigger signal during occurrence of said charge signal automatically advances occurrence of said trigger signal following occurrence of said charge signal.

6. The system set forth in claim 3 wherein said second electronic switch comprises an SCR.

* * * * *

UNITED STATES PATENT AND TRADEMARK OFFICE

CERTIFICATE OF CORRECTION

PATENT NO. : 6,408,820 B1
DATED : June 25, 2002
INVENTOR(S) : Gerald L. LaMarr, Jr.

It is certified that error appears in the above-identified patent and that said Letters Patent is hereby corrected as shown below:

Column 5,
Line 16, delete “coup led” and insert -- coupled --.

Signed and Sealed this

Third day of September, 2002

*Attest:*

*Attesting Officer*

JAMES E. ROGAN
*Director of the United States Patent and Trademark Office*

UNITED STATES PATENT AND TRADEMARK OFFICE

CERTIFICATE OF CORRECTION

PATENT NO. : 6,408,820 B1
DATED : June 25, 2002
INVENTOR(S) : Gerald L. LaMarr, Jr.

It is certified that error appears in the above-identified patent and that said Letters Patent is hereby corrected as shown below:

Title page,
Item [75], delete "Gerald L. LaMarr, Jr." and insert -- Gerald J. LaMarr, Jr. --

Column 6,
Line 16, delete "coup leld" and insert -- coupled --.

Signed and Sealed this

Sixteenth Day of September, 2003

JAMES E. ROGAN
*Director of the United States Patent and Trademark Office*